US005137242A

United States Patent [19]

Reath

[11] Patent Number: 5,137,242

[45] Date of Patent: Aug. 11, 1992

[54] HOLDER FOR SPECTACLES

[76] Inventor: Vern M. Reath, 2300 Fairview Rd. Y207, Costa Mesa, Calif. 92626

[21] Appl. No.: 638,045

[22] Filed: Jan. 4, 1991

[51] Int. Cl.[5] ..... A47F 7/02

[52] U.S. Cl. ..... 248/309.1; 248/902

[58] Field of Search ..... 248/309.1, 205.3, 206.5, 248/126, 902; 211/13; D16/129; D11/78.1

[56] References Cited

U.S. PATENT DOCUMENTS

| | | | |
|---|---|---|---|
| D. 298,436 | 11/1988 | Pralutsky | D16/129 |
| 2,104,612 | 1/1938 | Droll | 248/902 X |
| 2,467,251 | 4/1949 | Bowman | 248/902 X |
| 2,958,495 | 11/1960 | Foster | 248/309.1 X |
| 3,040,881 | 6/1962 | McNeill | 248/902 X |
| 3,259,348 | 7/1966 | Dann | 248/309.1 X |
| 3,561,077 | 2/1971 | Grant | 248/205.3 X |
| 3,895,718 | 7/1975 | Seiller | 248/902 X |
| 4,830,198 | 5/1989 | Colquitt | 211/13 X |
| 4,867,402 | 9/1989 | Benson et al. | D16/129 X |
| 4,986,426 | 1/1991 | Niklaus | 211/13 |

FOREIGN PATENT DOCUMENTS

| | | | |
|---|---|---|---|
| 2839148 | 3/1990 | Fed. Rep. of Germany | 248/309.1 |

*Primary Examiner*—Ramon O. Ramirez
*Assistant Examiner*—Robert A. Olson

[57] ABSTRACT

Disclosed is a device for holding spectacles. It is made of a unitary, flexible, resilient polymeric material formed into a receptacle member having a forward section and rear section separated by upwardly projecting, hinged walls. The forward section has a bridge rest and the rear section has a slot. The hinged walls flex outwardly to hold firmly spectacles placed into the device with the temples folded inwardly and inserted into the slot, the bridge of the frame resting on the bridge rest, and the hinged walls extending between the folded temples and the frame. The device is adapted to rest on a flat, horizontal surface or be mounted to a flat, vertical surface.

3 Claims, 1 Drawing Sheet

HOLDER FOR SPECTACLES

BACKGROUND DISCUSSION

1. Field of the Invention

This invention relates to a device for holding spectacles, in particularly, one that is convenient to use, easy and economical to manufacturer, can be mounted on a vertical surface or rest on a horizontal surface, and is versatile having the ability to hold a wide variety of different shaped and sized spectacles.

2. Background Discussion

Various types of spectacle or eye glass holders have been suggested. Examples of typical prior art spectacle stands are disclosed in the following patents:

| U.S. Pat. Nos. | U.S. Design Pat. Nos. |
|---|---|
| 3,291,429 | 298436 |
| 3,259,348 | 299246 |
| 4,702,451 | 299247 |
| 4,715,575 | 305340 |
| 4,779,829 | 306739 |
| 4,946,125 | |

All of these prior art spectacle holders or stands have limitations or structural features which render them incapable of functioning in the manner of the present invention. For example, they are unsuitable for standing or resting on a horizontal surface and still be conveniently mounted on a vertical surface, or they are difficult to the manufacturer economically, or they do not have the ability to hold a wide variety of different sizes and shapes of spectacles or they are unbalanced and do not hold the spectacles in a stable upright position, or they are difficult to use. Moreover, none of these prior art spectacle holders have the combination of features which make the present invention new and non-obvious.

SUMMARY OF THE INVENTION

The device of this invention has several features, no single one of which is solely responsible for its desirable attributes of convenience of use, ease and low cost manufacture, suitability for mounting on vertical or horizontal surfaces, and the versatility to hold a wide variety of different shapes and sizes of spectacles.

Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENT," one will understand how the features of this invention provide its desirable attributes.

The first feature of this invention is that the device is made of a unitary, flexible, resilient polymeric material formed into a receptacle member adapted to rest on a flat, horizontal surface or be mounted to a flat, vertical surface.

The second feature is the receptacle member has a forward section and a rear section separated by upwardly projecting walls. In the preferred embodiment the walls are hinged together. The forward section has a raised bridge rest, including a triangularly-shaped nose piece. The rear section is a slot adapted to hold the temples of the spectacles when they are folded inwardly. The spectacles are placed into the device with the temples folded inwardly and inserted into the slot, the bridge of the frame resting on the bridge rest, and the hinged walls extending between the folded temples and the frame.

The third feature is that the hinged walls are central, internal walls with their upper ends joined together to form a first hinge section. This first hinge section being made of a resilient material permits the internal, hinged walls to flex about the first hinge section upon placing the spectacles in the device. Upon insertion of the spectacles into the device, the upper ends of the central, internal walls extend between the temples and the frame of the spectacles, and the bridge of the frame is supported on the bridge rest, so that the spectacles are held in place in the receptacle member in a stable, upright position.

The fourth feature is that the rear section comprises internal and external walls, with lower ends of the walls joined together to form the slot which has a substantially V-shaped configuration and is adapted to receive the folded temples, which fit snug in the slot. A second hinge section is formed along the joint where the lower ends are connected, so that the internal and external walls can flex about this second hinge section and move away from each other or towards each other, depending upon the shape of the spectacles being placed in the device.

The fifth feature is that the bridge rest has an internal wall which has an upper end connected to an upper end of the internal wall of the rear section. These two walls constitute the central, internal hinged walls which are joined to form the first hinge section, which permits these walls to flex about the first hinge section upon placing the spectacles into the device. These two internal walls form a substantially inverted V-shaped configuration.

The sixth feature is that the hinged walls enable the forward and rear sections to move relative to each other in an accordion-like fashion, expanding and contracting to accommodate spectacles of different shapes and sizes and holding spectacles inserted therein firmly in an upright, stable position. The walls of the rear section can expand and contract to grasp firmly the folded temples when the spectacles are placed in the device of this invention.

BRIEF DESCRIPTION OF THE DRAWING

The preferred embodiment of this invention, illustrating all its features, will now be discussed in detail. This embodiment depicts the novel and non-obvious device of this invention shown in the accompanying drawing, which is for illustrative purposes only. This drawing includes the following figures (FIGS.), with like numerals indicating like parts.

DESCRIPTION OF THE PREFERRED EMBODIMENT

Figure 1:
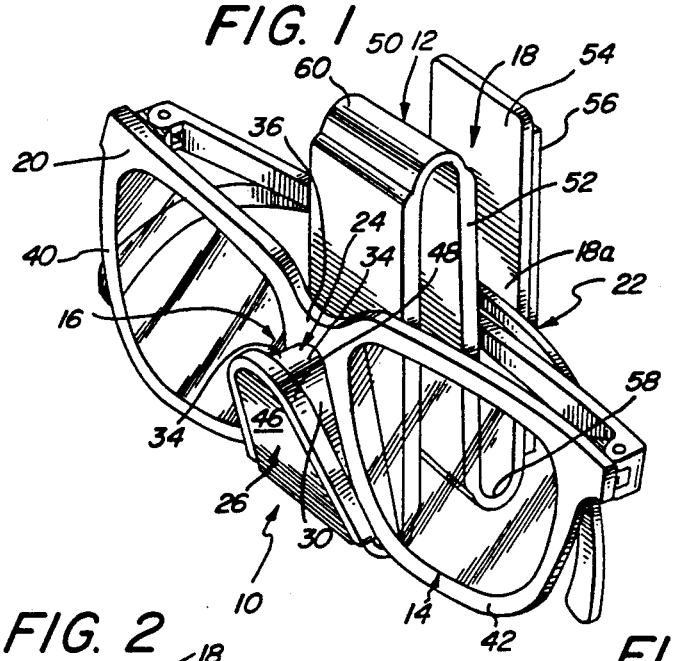
FIG. 1 is a perspective view of the device of this invention showing spectacles being held by the device.

As illustrated in FIG. 1, the device 10 of this invention is made of a unitary, flexible, resilient polymeric material such as a nylon resin, molded into a receptacle member 12 that provides support structure which is adapted to hold spectacles 14 in an upright position when either resting on a flat, horizontal surface, or mounted on a flat, vertical surface. The receptacle member 12 includes a forward section 16 and a rear section 18, with the forward section adapted to hold the frame 20 of spectacles 14 and the rear section 18 including a slot 18*a* adapted to hold inwardly folded temples 22 of the spectacles.

Figure 2:
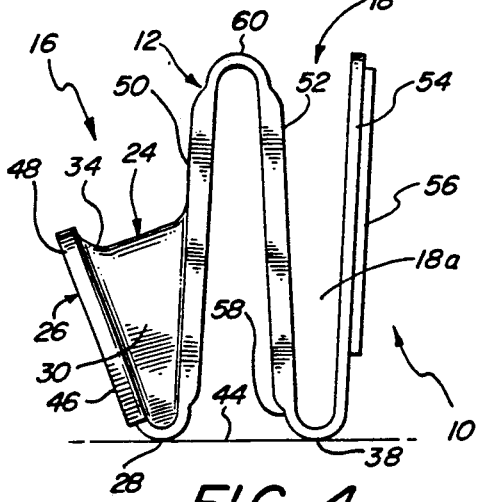
FIG. 2 is a side elevational view of the device of this invention.

The forward section 16 has a bridge rest 24 in the form of a triangularly-shaped nose piece 26 having a base 28 and slopping sides 30 and 32 which merge at an apex 34 pointing upwards towards the bridge 36 of the frame 20 of the spectacles 14. The underside of the slot 18*a* provides a base 38 which is essentially level with the base 28 of the nose piece 26 when the device 10 is place on a flat, horizontal surface. When the frame 20 is placed on the nose piece 26, the sloping sides 30 and 32 guide the apex 34 into engagement with the underside of the bridge 36, with these sloping sides engaging opposed lens retaining segments 40 and 42 of the frame 20 and supporting the frame. The two bases 28 and 38 may be placed on a flat, horizontal surface 44, so that the device 10 stands in a generally upright position as illustrated in FIG. 2.

Integral with the nose piece 26 is a forward front wall 46 which has about its perimeter a raised edge 48. This raised edge engages the outer edges of the lens retaining segments 40 and 42 of the frame 20 so that the frame does not slip off the nose piece 26. The apex 34 of the nose piece 26 slops downwardly from an internal wall 50 which is integral with the inward side of the nose piece 26. The internal wall 50 has a generally rectangular configuration with a width of approximately one-half to one inch and a height of approximately two and one-half to four inches. The height of the nose piece is approximately half the height of the rear wall. The downwardly sloping surface of the apex 34 curves upwardly slightly and joins with the raised edge 48 at the front wall 46. This facilitates proper placement of the bridge 36 on the nose piece 26.

Figure 3:
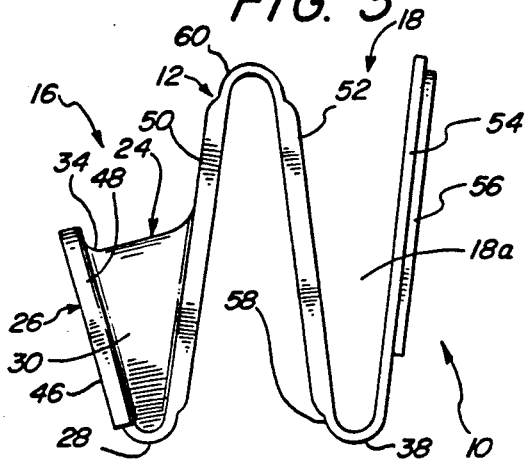
FIG. 3 is a side elevational view of the device of this invention expanded outwardly to illustrate how it can accommodate spectacles of different sizes and shapes.
Figure 4:
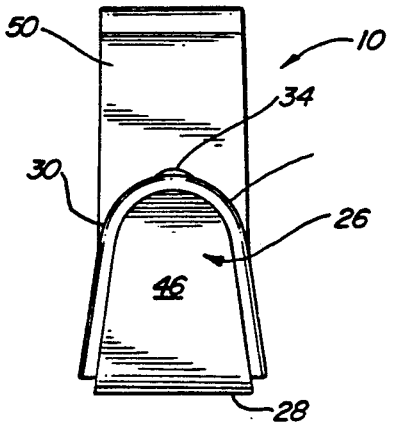
FIG. 4 is a front elevational view of the device of this invention.
Figure 5:
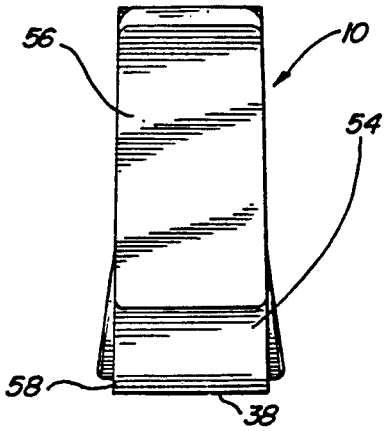
FIG. 5 is a rear elevational view of the device of this invention.

The rear section 18 is formed by two generally rectangularly shaped walls 52 and 54 having essentially the same dimensions as the internal wall 50 of the forward section 16. The external wall 54 has on its outer surface fastening means 56 for securing the device 10 to a vertical surface (not shown). Suitable fastening means 56 would include an adhesive strip, a magnetic strip, or one section of a hook-and-pile fastener such as sold under the Velcro® brand name. The two walls 52 and 54 of the rear section 18 are joined at their lower ends by a hinge section 58 to form a generally V-shaped configuration, with the two walls being adapted to flex inwardly and outwardly about the hinge section, depending upon the size and shape of the spectacles 14 being carried by the device 10. The upper ends of the two internal walls 50 and 52 are also joined together to form a hinge section 60, with these walls forming a generally inverted V-shaped configuration. These two internal walls 50 and 52 are adapted to flex towards and away from each other as the spectacles 14 are inserted into the device 10 to accommodate spectacles of different sizes and shapes. Comparing FIG. 2 to FIG. 3 illustrates how the walls 50, 52, and 54 flex about the hinge sections 58 and 60.

The device 10 of this invention is simple to use. It may be placed in a stable, upright position either on a flat, horizontal surface or mounted to a flat, vertical surface by securing the the rear wall 54 to a vertical surface. The temples 22 of the spectacles 14 are folded inwardly and the spectacles are placed in the receptacle member 12, with the nose piece 26 being inserted underneath the bridge 36 at the same time that the folded temples are placed into the slot 18*a* provided in the rear section 18. The two internal walls 50 and 52 extend upwardly between the frame 20 and the folded temples 22. The forward and rear sections, including the walls 50, 52, and 54, move relative to each other in an accordion-like fashion, expanding and contracting to accommodate spectacles of different shapes and sizes and holding spectacles inserted therein firmly in an upright, stable position. Thus, the frame 20 and folded temples 22 are held snugly in position, with the device 10 firmly holding the spectacles 14 in a stable, upright position so that the lenses of the spectacles are not scratched yet allows the spectacles to be easily removed when they are to again be worn.

SCOPE OF THE INVENTION

The above presents a description of the best mode contemplated of carrying out the present invention, and of the manner of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims.

I claim:

1. A device for holding spectacles including a frame with eye pieces connected by a bridge, and temples attached to the frame which can be folded inwardly towards the frame, said device comprising a receptacle member made of a unitary, flexible, resilient, polymeric material formed into a support structure which is adapted to rest on a flat horizontal surface or be mounted to a vertical surface, said receptacle member including a forward section having a bridge rest in the form of triangularly shaped nose piece with a raised perimeter adapted to engage the frame of the spectacles when the nose piece is inserted into the space between the eye pieces to engage the underside of the bridge of the frame, and a rear section comprising internal and external walls with lower ends joined together to form a slot of substantially V-shaped configuration which is adapted to receive the folded temples, said bridge rest having an internal wall which has an upper end connected to an upper end of the internal wall of the rear section to form a hinge at the connection, with said internal walls forming a substantially inverted V-shaped configuration, permitting the internal walls to to extend upwardly between the frame and temples upon placing the spectacles in the device with the temples folded inward and received in the slot and the bridge resting on the nose piece.

2. The device of claim 1 wherein the forward and rear sections move relative to each other in an accordion-like fashion, expanding and contracting to accommodate spectacles of different shapes and sized and holding spectacles inserted therein firmly in an upright, stable position.

3. A device for holding spectacles including a frame with eye pieces connected by a bridge, and temples attached to the frame which can be folded inwardly towards the frame, said device comprising a receptacle member made of a unitary, flexible, resilient, polymeric material formed into a support structure, said receptacle member including a forward section having a bridge rest in the form of triangularly shaped nose piece with a raised perimeter portion adapted to engage the frame of the spectacles when the nose piece is inserted into the space between the eye pieces to engage the underside of the bridge of the frame, and a rear section including a wall structure forming a slot of substantially V-shaped configuration which is adapted to receive the folded temples, said bridge rest having a wall member which has a section connected to the wall structure to form a hinge at the connection, with said wall member and said wall structure forming a substantially inverted V-shaped wedge element that extends upwardly between the frame and temples upon placing the spectacles in the device with the temples folded inward and received in the slot and the bridge resting on the nose piece.

* * * * *